US010760006B2

(12) United States Patent
Dugas et al.

(10) Patent No.: US 10,760,006 B2
(45) Date of Patent: Sep. 1, 2020

(54) METHODS AND SYSTEMS TO SEPARATE HYDROCARBON MIXTURES SUCH AS NATURAL GAS INTO LIGHT AND HEAVY COMPONENTS

(71) Applicant: Dow Global Technologies LLC, Midland, MI (US)

(72) Inventors: Ross E. Dugas, Lake Jackson, TX (US); Zubin B. Kuvadia, Lake Jackson, TX (US); Preshit Dandekar, Seattle, WA (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 16/451,821

(22) Filed: Jun. 25, 2019

(65) Prior Publication Data

US 2020/0002622 A1 Jan. 2, 2020

Related U.S. Application Data

(60) Provisional application No. 62/693,091, filed on Jul. 2, 2018.

(51) Int. Cl.

| | |
|---|---|
| ***C10G 5/06*** | (2006.01) |
| ***C10G 5/02*** | (2006.01) |
| ***F25J 1/00*** | (2006.01) |
| ***F25J 3/06*** | (2006.01) |

(52) U.S. Cl.

CPC ..... *C10G 5/06* (2013.01); *C10G 5/02* (2013.01); *F25J 1/0022* (2013.01); *F25J 3/0645* (2013.01); *C10G 2300/1025* (2013.01); *C10G 2300/4006* (2013.01); *C10G 2300/4012* (2013.01); *C10G 2300/4081* (2013.01); *F25J 2205/60* (2013.01)

(58) Field of Classification Search

CPC ..... B01D 2256/245; B01D 2257/7022; B01D 2257/80; B01D 45/08; B01D 53/002; B01D 53/02; B01D 53/0438; B01D 53/0462; B01D 53/0473; B01D 53/08; C10L 3/10; C10L 3/101; C10L 2290/543; C10L 2290/06; C10L 2290/542; C10L 2290/567; C10L 3/103; C10L 3/104; C10L 3/105; C10L 3/106; C10G 2300/1025; C10G 53/08; C10G 5/02; C10G 5/06

See application file for complete search history.

(56) References Cited

U.S. PATENT DOCUMENTS

| | | | | |
|---|---|---|---|---|
| 9,908,079 | B2 | 3/2018 | Rodgers et al. | |
| 2003/0191410 | A1* | 10/2003 | Yost | A61B 5/031 600/561 |
| 2006/0191410 | A1 | 8/2006 | Dolan et al. | |
| 2012/0222552 | A1* | 9/2012 | Ravikovitch | C01B 17/0408 95/97 |
| 2013/0186133 | A1* | 7/2013 | Ploeger | F25J 3/0209 62/636 |
| 2016/0001218 | A1 | 1/2016 | Rota | |

FOREIGN PATENT DOCUMENTS

| | | | |
|---|---|---|---|
| EP | 1 811 011 | A1 | 7/2007 |
| WO | 2015018333 | A1 | 2/2015 |
| WO | 2015130338 | A1 | 9/2015 |
| WO | 2015130339 | A1 | 9/2015 |
| WO | 2018085076 | A1 | 5/2018 |

OTHER PUBLICATIONS

F. Mueller, "Fundamentals of Gas Solids/Liquids Separation," Mueller Environmental Designs, Inc., Houston, TX, http://www.muellerenvironment.com/res/uploads/media//200-059-GMRC-2004-Separation.pdf, retrieved on Jun. 12, 2018, 15 pgs.

* cited by examiner

*Primary Examiner* — Sharon Pregler

(57) ABSTRACT

The present invention provides strategies to integrate adsorption and liquefaction techniques to separate hydrocarbon feed mixtures into purified light and heavy components, respectively. Initially, the hydrocarbon stream is separated into a light and heavy stream. The light stream can be integrated into a natural gas product. The heavy stream is partially liquefied. A first gas liquid separation of the partially liquefied heavy stream at an elevated pressure separates the liquid heavy stream from a methane-containing gas. The rejected methane component, which generally will include some rejected C2 and C3+ material, can be recycled to be combined with the feed mixture for re-processing. A further aspect of the strategy is then to practice at least one additional gas-liquid separation of the separated liquid heavy stream at a lower pressure effective to help further resolve the liquid heavy stream from C2-containing gas. The rejected C2 component, which generally will include some rejected C1 and C3+ material, can then be recycled back into the feed mixture for reprocessing or used as all or a portion of a light hydrocarbon product.

20 Claims, 5 Drawing Sheets

Table 2. Material Balance for Example 1

| | | FEED | PSAFEED | TREATED | TAIL | 1 | 2 | 3 | 4 | 5 | RECYC | 6 | 7 | OFFGAS | PRODUCT | NGL |
|---|---|---|---|---|---|---|---|---|---|---|---|---|---|---|---|---|
| Mole Flow | LBMOL/HR | 461.2 | 541.0 | 391.9 | 149.1 | 149.1 | 149.1 | 149.1 | 149.1 | 79.9 | 79.9 | 69.2 | 15.3 | 15.3 | 407.3 | 53.9 |
| Mass Flow | kg/hr | 4376 | 5077 | 2997 | 2080 | 2080 | 2080 | 2080 | 2080 | 701 | 701 | 1379 | 172 | 172 | 3169 | 1206 |
| Pressure | PSIG | 228 | 228 | 220 | 2 | 250 | 250 | 240 | 230 | 230 | 230 | 230 | 14 | 220 | 220 | 14 |
| Temperature | F | 68 | 70 | 65 | 50 | 394 | 120 | 104 | -25 | -25 | 80 | -25 | -65 | 120 | 68 | -65 |
| Component Mole Percent | | | | | | | | | | | | | | | | |
| C1 | | 82.5% | 82.6% | 94.7% | 50.7% | 50.7% | 50.7% | 50.7% | 50.7% | 83.1% | 83.1% | 13.3% | 55.1% | 55.1% | 93.2% | 1.5% |
| C2 | | 6.6% | 7.2% | 5.0% | 13.2% | 13.2% | 13.2% | 13.2% | 13.2% | 10.7% | 10.7% | 16.1% | 28.8% | 28.8% | 5.9% | 12.5% |
| C3 | | 5.9% | 5.8% | 0.1% | 21.0% | 21.0% | 21.0% | 21.0% | 21.0% | 5.2% | 5.2% | 39.1% | 14.4% | 14.4% | 0.6% | 46.2% |
| C4 | | 3.5% | 3.1% | 0.1% | 11.0% | 11.0% | 11.0% | 11.0% | 11.0% | 0.6% | 0.6% | 22.9% | 1.2% | 1.2% | 0.1% | 29.1% |
| C5 | | 1.0% | 0.9% | 0.0% | 3.1% | 3.1% | 3.1% | 3.1% | 3.1% | 0.0% | 0.0% | 6.6% | 0.1% | 0.1% | 0.0% | 8.4% |
| C6 | | 0.3% | 0.2% | 0.0% | 0.8% | 0.8% | 0.8% | 0.8% | 0.8% | 0.0% | 0.0% | 1.8% | 0.0% | 0.0% | 0.0% | 2.3% |
| CO2 | | 0.2% | 0.2% | 0.2% | 0.2% | 0.2% | 0.2% | 0.2% | 0.2% | 0.3% | 0.3% | 0.2% | 0.4% | 0.4% | 0.2% | 0.1% |
| H2O | | 0.0% | 0.0% | 0.0% | 0.1% | 0.1% | 0.1% | 0.1% | 0.1% | 0.1% | 0.1% | 0.0% | 0.1% | 0.1% | 0.0% | 0.0% |

Fig. 5

METHODS AND SYSTEMS TO SEPARATE HYDROCARBON MIXTURES SUCH AS NATURAL GAS INTO LIGHT AND HEAVY COMPONENTS

PRIORITY

The present nonprovisional patent application claims priority under 35 U.S.C. § 119(e) from United States Provisional patent application having Ser. No. 62/693,091, filed on Jul. 2, 2018, by Dugas et al. and titled METHODS AND SYSTEMS TO SEPARATE HYDROCARBON MIXTURES SUCH AS NATURAL GAS INTO LIGHT AND HEAVY COMPONENTS, wherein the entirety of said provisional patent application is incorporated herein by reference for all purposes.

FIELD OF THE INVENTION

The present invention relates to methods and systems to separate hydrocarbon mixtures such as natural gas into light and heavy components using a combination of adsorption and liquefaction (gas-liquid) separation techniques. More particularly, the present invention relates to such technology wherein the liquefaction separation treats the heavy stream at two or more pressure regimes to selectively favor separation between C1 and C3 hydrocarbons, respectively.

BACKGROUND OF THE INVENTION

Natural gas is a naturally occurring hydrocarbon gas mixture. Natural gas includes mainly saturated hydrocarbon components such as methane, ethane, propane, butane, and heavier hydrocarbons. Natural gas typically contains about 60-100 mole percent methane based on the total hydrocarbon content, with the balance of the hydrocarbon content being primarily heavier alkanes. Alkanes of increasing carbon number are normally present in decreasing amounts. The components of natural gas have many uses. For example, these can be used as a source of energy for heating, cooking, electricity, and pressure generation. The components also may be used as chemical feedstock in the manufacture of other chemicals, as fertilizers, as animal and fish feed, and the like. However, the components often are separated in order to be more suitable for a desired use.

"Raw natural gas" refers herein to natural gas as obtained from natural sources. In addition to hydrocarbons, raw natural gas may include other constituents including one or more of carbon dioxide, water, nitrogen, hydrogen sulfide, mercaptans, mercury, chlorides, helium, or the like. In some applications, these additional constituents are undesirable contamination and are removed in order to convert the natural gas into one or more useable products. In many desirable modes of practice, raw natural gas is treated using one or more purification processes in order to remove one or more of such contaminants to a desired degree. As used herein, the term "natural gas" will refer to raw natural gas that comprises at least one of C1 and/or C2 hydrocarbons as well as one or more C3+ hydrocarbons and that has been treated to remove at least a portion of one or more contaminants.

It is often desirable to separate natural gas into one or more light components (e.g., C1 and/or C2 enriched components) or heavy components (e.g., enriched in one or more C3+ hydrocarbons referred to herein as "natural gas liquid" materials). For example, it is financially desirable to recover natural gas liquids from natural gas to be used as petrochemical feedstocks where they have a higher value as compared to their value as a fuel gas component. Another reason is to meet pipeline specifications or liquefied natural gas (LNG) specifications for heating value, dew point, and condensation.

Moreover, oilfields are often located in remote locations where power grids have not yet been developed and electrical power is not available. For example, fuels such as diesel may be needed to run onsite oilfield equipment at remote locations. While natural gas is often readily available in such remote locations, the use of raw gas is not feasible unless a sufficient amount of the natural gas liquids have first been removed. Otherwise, natural gas containing too much NGL content may have elevated BTU levels and may not be suitable for gas combustion systems that are designed to operate within a narrow BTU range. Using a natural gas with too high of BTU level may require higher maintenance costs, higher operating temperatures, reduced equipment life expectancy, decreased power reduction, and/or generate increased pollution if operated at higher BTUs.

Many techniques for separating natural gas into desired components are known. Techniques include adsorption, gas-liquid separation, and combinations of these. Pressure swing adsorption (PSA) is one exemplary separation technique. In a conventional PSA process, an adsorbent is used that selectively adsorbs higher molecular weight hydrocarbons relative to methane and ethane under an elevated pressure, but then will readily release the adsorbed material when the pressure is reduced. This allows lighter components to be recovered in a first stage while heavier components are adsorbed under pressure. In a second stage, the heavier components can be separately recovered by releasing the pressure, which also regenerates the adsorbent for further use.

The light hydrocarbon stream resulting from adsorption may be highly purified with respect to C1 and/or C2 hydrocarbon content while containing very little C3+ hydrocarbon content. In the meantime, the recovered heavy material may be enriched with respect to C3+ hydrocarbon content but may still include more C1 and/or C2 content than may be desired. Accordingly, the resulting heavy hydrocarbon stream is further purified to remove more of the C1 and/or C2 content. This may be accomplished using liquefaction (gas-liquid) separation strategies in which some of the NGLs are condensed to separate them from lighter components in a gas phase.

Thus, a goal of natural gas separation is to obtain both a highly purified natural gas product containing predominantly C1 and/or C2 hydrocarbon material and a purified NGL product containing predominantly C3+ hydrocarbon material. However, it has been difficult to use liquefaction strategies to remove both C1 and C2 hydrocarbon material from the heavy stream. The result is that the heavy stream may include too much C2 content such that the C3+ hydrocarbon content remains more dilute than desired. Improved strategies to recover more concentrated heavy streams that are more easily resolved from both C1 and C2 hydrocarbon materials are desired.

SUMMARY OF THE INVENTION

The present invention provides strategies to integrate adsorption and liquefaction techniques to separate hydrocarbon feed mixtures into purified light and heavy components, respectively. Advantageously, the present invention improves the ability of liquefaction to resolve C1 and C2 hydrocarbons from C3+ hydrocarbons in order to recover high yields of the C3+ hydrocarbons in a purified NGL product. One aspect of the strategy is to initially practice a gas liquid separation of a heavy stream at an elevated pressure effective to help resolve the liquid heavy stream from methane gas. The rejected methane component, which generally will include some rejected C2 and C3+ material can be recycled to be combined with the feed mixture for reprocessing. A further aspect of the strategy is then to practice at least one additional gas liquid separation of the heavy stream at a lower pressure effective to help resolve the liquid heavy stream from C2 gas. The rejected C2 component, which generally will include some rejected C1 and C3+ material, can then be recycled back into the feed mixture for reprocessing or used as all or a portion of a light hydrocarbon product. By using separate liquefaction stages at different pressures to favor C1 and then C2 separation from the heavy stream, a heavy stream with high C3+ purity results with a reduced equipment cost.

In one aspect, the present invention relates to a method of separating C1 and C2 hydrocarbons from C3+ hydrocarbons, comprising the steps of:

a. providing a feed mixture comprising (i) at least one of C1 and/or C2 hydrocarbons, and (ii) one or more C3+ hydrocarbons;
b. using at least one adsorbent to separate the feed mixture into a light component that is enriched in C1 and/or C2 hydrocarbons relative to the feed mixture and a heavy component that is enriched in C3+ content relative to the feed mixture;
c. using pressure and temperature to cause the heavy component to be partially liquefied to include a first liquid portion and a first gas portion;
d. separating the, first liquid portion and the first gas portion, wherein the separated first liquid portion is enriched in at least one C3+ hydrocarbon relative to the heavy component, and wherein the separated first gas portion is enriched in methane relative to the heavy component;
e. reducing the pressure of the separated first liquid portion to separate the first liquid portion into a separated, second liquid portion and a separated, second gas portion, wherein the separated second liquid portion is enriched in at least one C3+ hydrocarbon relative to the separated first liquid portion, and wherein the separated second gas portion is enriched in ethane relative to the separated first liquid portion; and
f. incorporating at least one of the separated, first and second gas portions into the feed mixture.

In another aspect, the present invention relates to a method of separating C1 and C2 hydrocarbons from C3+ hydrocarbons, comprising the steps of:

a) providing a feed mixture comprising (i) at least one of C1 and/or C2 hydrocarbons, and (ii) one or more C3+ hydrocarbons;
b) using at least one adsorbent under conditions effective to separate the feed mixture into a first product stream and a first tail stream, wherein the first product stream is enriched in at least one of the C1 and/or C2 hydrocarbons relative to the feed mixture, and wherein the first tail stream comprises at least one of the C1 and/or C2 hydrocarbons and is enriched in at least one C3+ hydrocarbon relative to the feed mixture;
c) pressurizing and cooling the first tail stream to provide a pressurized and cooled tail stream that is partially liquefied;
d) withdrawing a first recycle stream from the pressurized and cooled tail stream in a manner effective such that the first recycle stream is enriched in at least one of the C1 and/or C2 hydrocarbons relative to the pressurized and cooled tail stream and to provide a tail remainder stream that is enriched in at least one C3+ hydrocarbon relative to the pressurized and cooled tail stream;
e) incorporating the withdrawn, first recycle stream into the feed mixture;
f) reducing the pressure of the tail remainder stream to provide a depressurized tail remainder stream;
g) withdrawing a second recycle stream from the depressurized tail remainder to provide a second product stream that is enriched in at least one C3+ hydrocarbon relative to the depressurized tail remainder stream, wherein the second recycle stream is enriched in at least one of the C1 and/or C2 hydrocarbons relative to the feed mixture; and
h) incorporating the second recycle stream into the first product stream downstream from using the adsorbent to separate the feed mixture into the first product stream and the first tail stream.

In another aspect, the present invention relates to a method of separating C1 and C2 hydrocarbons from C3+ hydrocarbons, comprising the steps of:

a) providing a feed mixture comprising (i) at least one of C1 and/or C2 hydrocarbons, and (ii) one or more C3+ hydrocarbons;
b) separating the feed mixture into a first product stream and a first tail stream, wherein the first product stream is enriched in at least one of the C1 and/or C2 hydrocarbons relative to the feed mixture, and wherein the first tail stream comprises at least one of the C1 and/or C2 hydrocarbons and is enriched in at least one C3+ hydrocarbon relative to the feed mixture;
c) partially liquefying the first tail stream under conditions such that the partially liquefied first tail stream comprises at least one tail stream gas and at least one tail stream liquid;
d) withdrawing a first recycle stream from the partially liquefied tail stream to provide a tail remainder stream that is enriched in at least one C3+ hydrocarbon relative to the partially liquefied tail stream, wherein the first recycle stream comprises at least a portion of the tail stream gas and is enriched in at least one of the C1 and/or C2 hydrocarbons relative to the tail stream;
e) incorporating the withdrawn, first recycle stream into the feed mixture;
f) reducing the pressure of the tail remainder stream under conditions effective to provide a depressurized tail remainder stream comprising at least one tail remainder gas and at least one tail remainder liquid;
g) separating the depressurized tail remainder stream into a second recycle stream and a second product stream, wherein the second product stream is enriched in at least one C3+ hydrocarbon relative to the depressurized tail remainder stream, and wherein the second recycle stream is enriched in at least one of the C1 and/or C2 hydrocarbons relative to the feed mixture; and
h) incorporating at least one of the first recycle stream and the second recycle stream into the feed mixture.

In another aspect, the present invention relates to a method of using a pressure swing adsorbent system and a liquefaction system to separate C1 and C2 hydrocarbons from C3+ hydrocarbons, comprising the steps of:

a) providing a feed mixture to the pressure swing adsorbent system, wherein the feed mixture comprises (i) at least one of C1 and/or C2 hydrocarbons, and (ii) one or more C3+ hydrocarbons, and wherein the pressure swing adsorbent system comprises at least one adsorbent;

b) using the at least one adsorbent to separate the feed mixture into a first product stream and a first tail stream, wherein the first product stream is enriched in at least one of C1 and/or C2 hydrocarbons relative to the feed mixture, and wherein the first tail stream is enriched in at least one C3+ hydrocarbon relative to the feed mixture;

c) using the liquefaction system at one or more pressures in a first pressure range to separate the first tail stream into a first recycle stream and a tail remainder stream, wherein the first recycle stream is enriched in at least one of C1 and/or C2 hydrocarbons relative to the first tail stream, and wherein the remainder tail stream is enriched in at least one C3+ hydrocarbon relative to the first tail stream;

d) using the liquefaction system at one or more pressures in a second pressure range to separate the tail remainder stream into a second recycle stream and a second product stream, wherein the second pressure range is less than the first pressure range;

e) incorporating the first recycle stream into the feed mixture; and f) incorporating the second recycle stream into the first product stream downstream from the pressure swing adsorbent system.

In another aspect, the present invention relates to a system for separating C1 and C2 hydrocarbons from C3+ hydrocarbons, comprising:

a) an adsorbent bed system comprising one or more adsorbent beds, each adsorbent bed comprising one or more adsorbents that selectively adsorb C3+ hydrocarbons relative to C1 and/or C2 hydrocarbons from a feed mixture comprising (i) at least one of C1 and/or C2 hydrocarbons; and (ii) one or more C3+ hydrocarbons, wherein the adsorbent bed system comprises:

i. a first configuration in which the feed mixture is separated into at least one C1 and/or C2 enriched output stream while one or more C3+ enriched portions of the feed mixture are selectively adsorbed onto at least one adsorbent bed;

ii. a second configuration in which the one or more C3+ portions of the feed mixture are released from at least one of the one or more adsorbent beds to provide at least one C3+ enriched, first tail stream;

iii. at least one supply conduit pathway through which the feed mixture is supplied to the adsorbent bed system;

iv. at least one outlet conduit through which at least one C1 and/or C2 enriched output stream is discharged from the adsorbent bed system while one or more C3+ hydrocarbons of the feed mixture are selectively adsorbed onto the one or more adsorbent beds relative to the C1 and/or C2 hydrocarbons in the feed mixture; and v. at least one outlet conduit through which the at least one C3+ enriched, first tail stream is discharged from the adsorbent bed system;

b) a liquefaction system, comprising:

i. a first separation portion that separates the C3+ enriched, first tail stream into a first recycle stream and a tail remainder stream, wherein the first recycle stream is enriched in C1 and/or C2 hydrocarbons relative to the C3+ enriched, first tail stream, and wherein the tail remainder stream is enriched in at least one C3+ hydrocarbon relative to the C3+ enriched, first tail stream; and ii. a second separation portion that separates the tail remainder stream into a second recycle stream and a further C3+ enriched tail stream, wherein the second recycle stream is enriched in C1 and/or C2 hydrocarbons relative to the tail remainder stream, and wherein the further C3+ enriched tail stream is enriched in at least one C3+ hydrocarbon relative to the tail remainder stream;

c) a first recycle pathway that couples the liquefaction system to the adsorbent bed system in a manner effective to cause the first recycle stream to be incorporated into the feed mixture upstream from at least one adsorbent bed of the pressure swing adsorption system; and d) a second recycle pathway that causes the 2nd recycle stream to be incorporated into the first product stream downstream from the adsorbent bed system.

BRIEF DESCRIPTION OF THE DRAWINGS

FIG. 5 is a table of calculated data showing a material balance when in a hypothetical instance an illustrative feed mixture is separated into purified light and heavy components by practicing the method of FIG. 1 in the system of FIG. 2.

DETAILED DESCRIPTION OF PRESENTLY PREFERRED EMBODIMENTS

Figure 1:
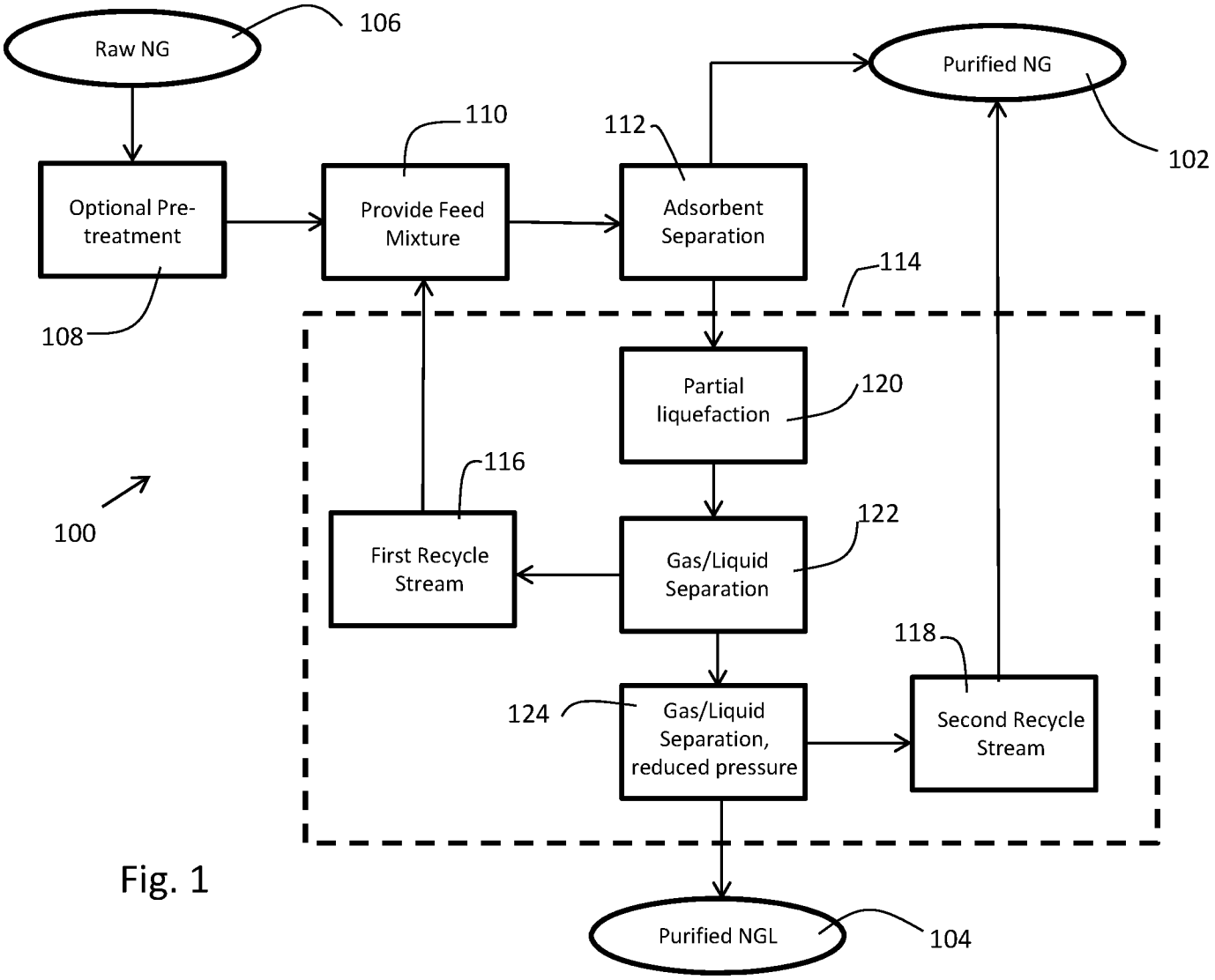
FIG. 1 is a schematic illustration of one embodiment of a method of the present invention useful to separate hydrocarbon feed mixtures into purified light and heavy components, respectively.

The present invention will now be further described with reference to the following illustrative embodiments. The embodiments of the present invention described below are not intended to be exhaustive or to limit the invention to the precise forms disclosed in the following detailed description. Rather a purpose of the embodiments chosen and described is so that the appreciation and understanding by others skilled in the art of the principles and practices of the present invention can be facilitated.

The present invention provides methods and systems for separating C1 and/or C2 hydrocarbons from one or more C3+ hydrocarbons in hydrocarbon feed mixtures. The present invention may be used for separations for a wide range of mixtures including C1 and/or C2 hydrocarbons as well as C3+ hydrocarbons. Exemplary embodiments of such mixtures may contain from 5 to 95 moles of C1 and/or C2 hydrocarbons per 5 to 95 moles of C3+ hydrocarbons. The present invention is particularly useful to separate mixtures containing 5 to 30, preferably 5 to 25, more preferably 5 to 20 moles of C3+ hydrocarbons per 80 to 100 moles of C1 and/or C2 hydrocarbons. As used herein, all amounts of materials are given on a mole basis unless otherwise expressly noted. As used herein, mole percent is based on the total moles of hydrocarbons unless otherwise expressly stated. The principles of the present invention are advantageously used with respect to natural gas as all or part of the feed mixture.

As used herein, a "hydrocarbon" is an organic compound formed entirely from hydrogen and carbon atoms. Hydrocarbons include alkanes, alkenes, alkynes, and aromatic compounds. Hydrocarbons may be linear, branched, and/or cyclic. Some cyclic embodiments may include bridge moieties or spyro carbon moieties. Cyclic embodiments of alkanes may be referred to as cycloalkanes. Aromatic hydrocarbons may include one or more aromatic rings. When an aromatic hydrocarbon includes two or more rings, these may be fused (e.g., naphthalene as one example) or linked by a single bond (e.g., biphenyl as one example) or a suitable divalent hydrocarbon linking group (e.g., diphenylmethane as one example).

A hydrocarbon or group of hydrocarbons may be referred to by the designation C(N), where C is a symbol representing carbon and (N) is a number indicating the number of carbon atoms in the hydrocarbon or group of hydrocarbons. For example, C1 refers to methane, the smallest hydrocarbon having one carbon atom. C2 refers to hydrocarbons with 2 carbon atoms such as ethane, ethene, and ethyne. C3 refers to hydrocarbons with 3 carbon atoms, etc. Polymeric hydrocarbons such polyethylene, polypropylene, polystyrene, ultrahigh molecular weight polyethylene, and the like may have large (N) values including but not limited to (N) values in the range from 50 to 100,000 or even higher. This designation approach also may be used to refer to hydrocarbons having carbon atoms in a range. For example, the designations C1-4 or C1 to C4 both refer to hydrocarbons having from 1 to 4 carbon atoms. As another example, the designation C(N)+ refers to hydrocarbons having N or more carbon atoms. According to this kind of designation, C3+ refers to hydrocarbons having 3 or more carbon atoms. The present invention is particularly useful for separating C1 and/or C2 hydrocarbons from C3+ hydrocarbons.

One commercially important practice involves separating natural gas into a light hydrocarbon component and a heavy hydrocarbon component, respectively. As used herein, the term "light" with respect to a hydrocarbon processing refers to a component (which may be a batch or stream) that contains an enriched C1 and/or C2 hydrocarbon content and that was obtained from a hydrocarbon feed mixture comprising C1 and/or C2 hydrocarbons as well as one or more C3+ hydrocarbons. Desirably, the C3+ content in such light hydrocarbon components is less than 10 mole percent, more desirably less than 5 mole percent, or even more desirably less than 2 mole percent based on the total quantity of hydrocarbons in the light hydrocarbon component. As used herein, the term "treated gas" shall also be used to refer to a light component separated from a hydrocarbon mixture. The term "heavy" with respect to hydrocarbon processing refers to a component that comprises one or more enriched C3+ hydrocarbons and that was obtained from a hydrocarbon feed mixture comprising C1 and/or C2 hydrocarbons as well as one or more C3+ hydrocarbons. Desirably, the C1 and C2 content in such a purified heavy hydrocarbon component is less than 30 mole percent, even less than 25 mole percent, even less than 20 mole percent, even less than 15 mole percent, or even less than 10 mole percent of C1 and C2 hydrocarbons based on the total quantity of hydrocarbons in the heavy component. Advantageously, the present invention provides methods and systems to separate natural gas mixtures into such heavy and light components.

In the natural gas industry, the term "natural gas liquids" or "NGL" has been used to refer to the C2+ content of raw natural gas or natural gas. This approach to defining NGL implies a separation between C1 on the one hand, and C2+ hydrocarbons on the other hand. The present invention, in contrast, is particularly suitable for separating C1 and C2 hydrocarbons as the light component from C3+ hydrocarbons as the heavy component. Accordingly, in the practice of the present invention, the terms "natural gas liquids" or "NGL" or "heavy" shall refer to a heavy component comprising C3+ hydrocarbons that is separated from a hydrocarbon mixture comprising C1 and/or C2 hydrocarbons as well as one or more C3+ hydrocarbons. According to such terminology, the present invention allows raw natural gas or natural gas to be separated into purified treated gas on the one hand and purified natural gas liquids on the other hand.

The term "enriched" is used herein to refer to the purification of one or more components of a hydrocarbon mixture. The term "enriched" means that the concentration of the component(s) is higher in the separated component relative to the mixture that was treated to produce the separated component. For example, when a feed mixture containing 80 mole percent C1 and C2 hydrocarbons and 20 mole percent C3+ hydrocarbons is separated into a light component containing 98 mole percent C1 and C2 hydrocarbons and 2 mole percent C3+ hydrocarbons, the light component is enriched with respect to the C1 and C2 hydrocarbons. Additionally, the C1 and C2 hydrocarbons are also described as being purified in the light stream. Similarly, if the same feed mixture is processed to produce a heavy component containing 70 mole percent C3+ hydrocarbons and 30 mole percent C1 and C2 hydrocarbons, then the heavy component is enriched or purified with respect to C3+ hydrocarbons. The principles of the present invention enrich or purify the heavy component of hydrocarbon mixtures in stages to provide a purification strategy that overall is effective at purifying the heavy component in an economical manner with high yield while at the same time producing a highly pure light component with high yield.

Hydrocarbons may be gases, liquids, or solids at standard temperature and pressure (referred to as "STP" conditions, which are 25° C. and 1 atm absolute). For example, methane, ethane and propane are gases at STP conditions. Hexane and benzene are examples of hydrocarbons that are liquids at STP conditions. Waxes (paraffin wax and naphthalene, for instance) and polymers such us polyethylene, polypropylene, and polystyrene are examples of hydrocarbons that are solids at STP conditions.

Adjusting temperature and pressure of a hydrocarbon mixture can allow hydrocarbons that are gases at STP conditions to be in liquid form. For example, by chilling and pressurizing a hydrocarbon mixture, hydrocarbons with 3 or more carbon atoms can be caused to be predominantly in liquid form while hydrocarbons with 1 or 2 carbon atoms remain predominantly in gas form. Because gases and liquids are easy to separate using gas/liquid separation techniques, applying cooling and pressurization to hydrocarbon mixtures allows the smaller, lighter hydrocarbons such as methane, ethane, ethene, and ethyne in the gas phase to be separated from the heavier hydrocarbons having 3 or more carbon atoms in the liquid phase. In actual practice, the gas may include some C3+ content, but this tends to be depleted relative to the starting mixture that was separated.

The liquid may include some C1 and/or C2 content, but this tends to be depleted relative to the starting mixture that was separated.

The techniques of using cooling and/or pressure to help resolve hydrocarbon mixtures work, at least in part, by partially liquefying the mixtures. Liquefaction causes the heavier species to be in liquid form, while the lighter species tend to be in gas form. However, not all hydrocarbon mixtures have a content that makes it economical to directly apply liquefaction techniques. The present invention advantageously applies an initial separation (preferably using adsorption techniques as described below) in order to separate a feed mixture into a lighter stream in which the C1 and C2 content is enriched relative to the feed mixture and a heavier stream in which one or more of the C3+ hydrocarbons are enriched relative to the feed mixture. The resultant heavier stream is now sufficiently concentrated or enriched with respect to C3+ hydrocarbons to allow gas-liquid separation to be carried out more effectively.

In fact, this initial separation may be readily practiced so that the lighter stream is highly pure with respect to C1 and/or C2 content, containing less than 10 mole percent, or even less than 5 mole percent, or even less than 2 mole percent of C3+ hydrocarbons based on the total quantity of the hydrocarbons in the stream. At such a level of purity, the lighter stream is pure enough in C1 and/or C2 to be useable as a natural gas pipeline product. Hence, this lighter stream also may be referred to as a first product stream produced by the methods and systems of the present invention. Such a natural gas product may be used in many ways. For example, the natural gas may be used as fuel to generate power or heat, as raw materials to prepare other compounds, or even flared in whole or in part if disposal is desired.

In the meantime, the heavier or first tail stream provided by the initial separation is enriched in C3+ hydrocarbons relative to the feed mixture but still may include a substantial amount of C1 and C2 content. For example, the first tail stream in some embodiments includes from 15 to 70, often from 20 to 65 moles of C3+ hydrocarbons per 100 moles of hydrocarbons in the stream. Such a composition may not be pure enough yet in C3+ species to be suitable for use in NGL applications, but the initial degree of enrichment advantageously makes the first tail stream much more suitable to be further purified using liquefaction separation techniques. A further aspect of the present invention is to carry out liquefaction separation in multiple stages in combination with multiple recycling strategies to allow high levels of separation and usage as between the C1-C2 and C3+ content of the initial feed mixture. For example, the resultant purified NGL stream in the practice of the present invention may include 80 to 95 moles of C3+ hydrocarbons per 5 to 20 moles of C1 and/or C2 hydrocarbons. In one mode of practice, a purified NGL stream includes 85 moles of C3+ hydrocarbons per 12 moles of C2 hydrocarbons, and 85 moles of C3+ hydrocarbons per 1.5 moles of C1 hydrocarbons.

FIG. 1 schematically shows an illustrative method 100 of the present invention for processing a feed mixture comprising C1 and/or C2 hydrocarbons as well as one or more C3+ hydrocarbons. Method 100 separates the C1 and C2 hydrocarbons from C3+ hydrocarbons into light hydrocarbon stream 102 containing purified natural gas (NG) and heavy hydrocarbon stream 104 containing purified natural gas liquid (NGL), respectively. For purposes of the present invention, FIG. 1 shows a raw natural gas stream provided in step 106 being separated into the light and heavy hydrocarbon streams 102 and 104. In step 108, the raw natural gas stream optionally is subjected to one or more pre-treatments in order to remove one or more contaminants from the raw natural gas to a desired degree. The resultant natural gas is then incorporated into a feed mixture in step 110. At this early stage of processing, the feed mixture in step 110 comprises at least one of C1 and/or C2 hydrocarbons and one or more C3+ hydrocarbons. Often, the C3+ hydrocarbons include at least C3, C4, C5, and C6 hydrocarbons. Higher hydrocarbons, e.g., C7+ hydrocarbons, may also be present.

The present invention is particularly useful when the feed mixture provided in step 110 has a concentration of C3+ hydrocarbons that is too dilute to be economically purified by using gas/liquid separation techniques upon the feed mixture directly. In such instances, an initial purification of the C3+ content is performed using one or more other purification techniques before turning to liquefaction separation techniques to undertake further purification. For example, an illustrative feed mixture of this type may incorporate 5 to 20 moles of C3+ hydrocarbons per 100 moles of hydrocarbons in the stream. Desirably, a hydrocarbon mixture includes at least 20 or more moles of C3+ hydrocarbons per 90 to 110 moles of C1 and/or C2 hydrocarbons in order to be more suitable for gas/liquid separation. Accordingly, method 100 practices an initial separation in step 112 in order to provide a heavier hydrocarbon stream that is more suitable for gas/liquid separation while at the same time providing a more purified light hydrocarbon stream.

In illustrative modes of practice, the initial separation practiced in step 112 involves using an adsorbent under conditions effective to separate the feed mixture into a first product stream that is enriched in the light hydrocarbon components and a first tail stream that is enriched in the C3+ components. Step 112 is based on a principle that C3+ hydrocarbons are selectively adsorbed onto the surface of a suitable adsorbent material when the feed mixture is caused to contact the adsorbent. Pressure and temperature of the feed mixture may be independently selected to help enhance the selective adsorption of the C3+ hydrocarbons. Generally, pressures and temperatures can be selected to favor the selective adsorption of the heavy hydrocarbon materials.

One factor contributing to this selective behavior is that the vapor pressures of the heavy hydrocarbon components are distinctly lower than those of the light hydrocarbon components at higher pressures and lower temperatures, making it easier for the adsorption forces to act upon the heavy hydrocarbon components. Also as a general principle, the higher the pressure, the more of the heavy components that are adsorbed at a given temperature. Later, reducing the pressure causes adsorbed material to be desorbed, or released, from the adsorbent. In addition to vapor pressure phenomena, the larger molecules also tend to be more strongly attracted to the adsorbent surfaces via intermolecular interactions.

These adsorption principles allow the heavy and light components of the feed mixture to be separated in an illustrative pressure swing adsorption (PSA) strategy that comprises a loading or adsorption portion and a regeneration/release portion. In a first adsorption or loading portion, the feed mixture is caused to contact one or more adsorbent beds comprising one or more adsorbent materials while the feed mixture is under relatively high pressure at one or more temperatures in a suitable range. In illustrative embodiments, the pressurized feed mixture may be at a pressure in the range from 50 to 700 psig, preferably 150 to 250 psig and a temperature in the range from 0 C to 100 C, preferably 10

C to 60 C. In one mode of practice, a temperature of 27 C and a pressure of about 230 psig would be suitable.

As the feed mixture flows through the adsorbent bed(s), the feed mixture intimately contacts the adsorbent material. The result is that C3+ hydrocarbon material is selectively incorporated onto the adsorbent surfaces in much greater amounts than the C1 and C2 materials are adsorbed. This causes the flowing feed mixture to become depleted in C3+ hydrocarbons while become enriched in C1 and C2 hydrocarbons relative to the feed mixture supplied to the bed(s). Further, the adsorbed, trapped material tends to be enriched in C3+ material and depleted in C1 and C2 material relative to the feed mixture. The flowing mixture that is now enriched in C1 and C2 material can be independently withdrawn as a first product stream as the adsorption of the heavy material progresses. In exemplary modes of practice, the withdrawn stream of light hydrocarbons may be highly purified even at this initial stage with respect to C1 and C2 hydrocarbons while including only a small amount of C3+ hydrocarbons. The result is that the withdrawn light stream 102 may be sufficiently pure to use as a light hydrocarbon gas product without further processing, if desired.

For example, as obtained from using the adsorbent in step 112, the withdrawn light hydrocarbon stream 102 may contain less than 5, even less than 3, or even less than 1 mole of C3+ hydrocarbons per 100 moles of C1 and/or C2 hydrocarbons.

Optionally, however, the light stream may be further purified or otherwise handled, if desired. Further, in the practice of the present invention, an auxiliary product stream shown as the second recycle stream obtained in step 118 from gas/liquid separation may be combined with the light hydrocarbon stream (such combination is described further below) in order to enhance recovery of the purified C1 and C2 hydrocarbons from the feed mixture provided in step 110.

For example, in a typical PSA process, a natural gas stream is caused to flow through or past one or more adsorbent beds to allow the feed mixture to intimately contact the adsorbent material. As this flow continues, the concentration of the adsorbed material tends to gradually increase. The concentration of adsorbed material in the beds generally is not uniform throughout the bed, particularly on a bed whose adsorbent capacity is well below its saturation point. Instead, the concentration of the adsorbed material tends to be highest toward the upstream end of an adsorbent bed and will tail off gradually downstream through a mass transfer zone in the adsorbent material. As the adsorbing stage continues, the mass transfer zone will progressively move downstream in the adsorbent bed.

The adsorbent bed(s) generally have a large yet limited capacity to adsorb components of the feed mixture. At some point, the adsorbent bed(s) may become saturated and unable to adsorb further material. At and beyond saturation, the feed mixture generally would tend to flow through the adsorbent bed(s) unaffected. Accordingly, the flow of the feed mixture is desirably stopped before saturation is reached to help make sure that the feed mixture is appropriately treated to separate the light and heavy materials in the desired manner.

At some point, if the process continues long enough, amounts of the component to be removed unduly break though the downstream end of the bed. Before this breakthrough occurs, it is desirable to stop the flow of the feed mixture, ending the adsorbing stage. The bed can then be regenerated in a second processing stage by releasing or desorbing the adsorbed material in an independent, withdrawn tail stream.

After the flow of the feed mixture through the adsorbent beds is stopped, the pressure of the beds is reduced to carry out the second or regeneration stage of a PSA process. The pressure drop tends to cause adsorbed materials to be released, or desorb, from the adsorbent bed(s). The temperate may be actively increased, if desired, to enhance release of material from the adsorbent(s), but excellent release generally tends to occur without having to actively adjust the temperature. In the absence of active temperature adjustment, the adsorbent environment may tend to cool on its own accord as the pressure is reduced. This not only regenerates the adsorbent material, but it also allows the released material to be withdrawn as a first tail stream that is enriched in C3+ hydrocarbons relative to the feed mixture. This first tail stream taken from the adsorbent bed(s) may still tend to include a substantial amount of C1 and C2 material. The result is that the first tail stream may include too much C1 and/or C2 content to provide a natural gas liquid stream of desired purity. However, the C3+ concentration of the first tail stream, being enriched relative to the feed mixture, is now much more suitable for use in gas/liquid separation strategies to further purify the C3+ content.

To assist in release and withdrawal of adsorbed material, a purge stream can be flowed through the adsorbent bed(s). Desirably, the purge stream flows in a counter-current fashion relative to the direction in which the feed mixture flowed through the bed. As one option, a portion of the first product stream, whose concentration of C3+ material is depleted relative to the feed mixture, can be used as all or a portion of the purge stream. Optionally, other purge materials, such as nitrogen, clean dry air, or the like may be used.

In view of this discussion, a typical PSA system involves two or more vessels. These are operated in a coordinated manner to continuously treat the feed mixture by carrying out the adsorption in at least one vessel while regeneration occurs in at least one other vessel. When the adsorbent media used for adsorption become sufficiently full of adsorbed material, the roles of the vessels are switched so that the regenerated vessel(s) are now used for adsorption while the more full adsorbent media undergo regeneration and release of the adsorbed material. Dual stage PSA (also known as DS-PSA) processes are examples of this strategy in which two adsorbent bed vessels are operated in coordinated fashion to allow continuous processing of feed mixtures. An illustrative embodiment of a DS-PSA system is described in Assignee's co-pending PCT Pat. Pub. No. WO/2018/085076. Examples of PSA systems also are described in U.S. Pat. Pub. No. 2006/0191410; US Pat. Pub. No. 2012/0222552; WO 2015/130339; WO 2015/130338; WO 2015/18333; EP 1811011A1. System 200 described below with respect to FIG. 2 may use a dual-stage PSA system to provide adsorbent separation functionality.

Still referring to FIG. 1, suitable adsorbent materials provide adsorption characteristics to selectively adsorb C3+ hydrocarbons relative to C1 and C2 hydrocarbons. Adsorption generally refers to the adhesion of a material, the adsorbate, onto a surface. Adsorption most commonly involves physical, electrostatic, ionic, magnetic, complexing, and/or similar interactions between the adsorbate and the adsorbing surface. Adsorbents commonly are solids, semi-solids, gels, or the like. Suitable adsorbent materials often operate via not only adsorption phenomena, but optionally also may interact with the feed mixture by one or more other functionalities such as absorption or the like.

Accordingly, the term "adsorbent" as used in the present invention refers to materials that incorporate at least but are not limited to adsorbent functionality.

In order to provide a large adsorption capacity, an adsorbent desirably has a relatively large surface area. Desirably, an adsorbent material has porosity characteristics in order to provide large surface area characteristics. In illustrative embodiments, an adsorbent may have a surface area in the range from 100 $m^2/g$ to 2000 $m^2/g$, even 500 $m^2/g$ to 1500 $m^2/g$, or even 1000 $m^2/g$ to 1300 $m^2/g$. In the practice of the present invention, surface area of an adsorbent may be measured as the BET specific surface area.

A wide range of adsorbent materials with suitable surface area and the desired selectivity are available to be used in the practice of the present invention. Examples include one or more of silica, silica gel, alumina, silica-alumina, zeolites, activated carbon, polymer supported silver chloride, copper containing resins, polymers (such as a partially pyrolized macroporous polymer or macroporous alkylene-bridged adsorbent polymer as described in Assignee's Co-Pending PCT Pat. Pub. No. WO/2018/085076 or in U.S. Pat. No. 9,908,079 B2.

Referring still to FIG. 1, step 114 involves using a liquefaction system to generate the purified NGL product 104 as well as to provide first and second recycle streams 116 and 118. Step 114 incorporates a combination of partial liquefaction and gas/liquid separation steps 120, 122, and 124 in order to generate the product 104 and recycle streams. In step 120, the first tail stream obtained from step 112 is pressurized and cooled under conditions effective to partially liquefy the first tail stream. In some embodiments the liquefaction system includes dehydration of water or other pretreatment.

The first tail stream may be cooled in one or more cooling stages to achieve the desired partial liquefaction. In illustrative embodiments, the first tail stream is cooled to a temperature in the range from −50 C to 25, preferably −40 C to 15 C, more preferably −30 C to 0 C.

The first tail stream may be pressurized in one or more pressurizing stages to achieve the desired partial liquefaction. In illustrative embodiments, the first tail stream is pressurized to a pressure in the range from 20 psig to 500 psig, preferably 50 psig to 300 psig, more preferably 50 psig to 150 psig. Higher pressures can be used but are more costly.

As a result of the partial liquefaction, the pressurized and cooled first tail stream includes at least one gas or vapor and at least one liquid. Generally, the gas is enriched in C1 and C2 hydrocarbons relative to the first tail stream as supplied to step 114. Similarly, the liquid is enriched in C3+ hydrocarbons relative to the first tail stream as supplied to step 114. This separation allows the gas and liquid to be easily separated from each other.

Accordingly, a gas/liquid separation (also known as vapor-liquid separation) is performed in order to separate the liquid and gas of the partially liquefied tail stream. The gas and liquid separation may be accomplished using a variety of suitable techniques. According to one general method of operation, gravity is used to cause the liquid to settle toward the bottom of a suitable vessel, where the liquid can be withdrawn. In the meantime, the gas or vapor generally rises to the top of the vessel, where the gas or vapor can be withdrawn. In addition to gravity, other separation forces may be used such as centrifugal force or the like. A variety of equipment to accomplish gas-liquid separation are known. Examples include flash drums, breakpots, knock-out drums, knock-out pots, compressor suction drums, compressor inlet drums, demisters, centrifugal separator, impingement separator, filter separator, and the like. Gas-liquid separation is further described in F. Mueller, "Fundamentals of Gas Solids/Liquids Separation," Mueller Environmental Designs, Inc., Houston, Tex., http://www.muellerenvironmental.com/res/uploads/media//200-059-GMRC-2004-Separation.pdf, retrieved on Jun. 12, 2018; Chemical Engineers Handbook, Perry et al., 7$^{th}$ ed., © 1997, McGraw Hill Co., Inc.; Handbook of Separation Techniques for Chemical Engineers, P. A. Schweitzer, 3d ed, © 1997, McGraw Hill Co., Inc.

As a result of the gas liquid separation performed in step 122, the separated gas or vapor is withdrawn as a first recycle stream in step 116. This first recycle stream is withdrawn from the pressurized and cooled tail stream in a manner to separate the withdrawn gas material from the liquid, which provides a tail remainder stream. The first recycle stream is enriched in C1 and C2 hydrocarbons relative to the partially liquefied tail stream fed to step 122. The tail remainder stream is enriched in C3+ hydrocarbons relative to the partially liquefied tail stream fed to step 122. In a typical mode of practice, the tail remainder stream contains 50 to 80 moles of C3+ hydrocarbons per 20 to 50 moles of C1 and/or C2 hydrocarbons, more preferably 60 to 75 moles of C3+ hydrocarbons per 100 moles of hydrocarbons in the stream. In one exemplary mode of practice, the tail remainder stream includes 70 moles of C3+ hydrocarbons per 13 moles of methane and 70 moles of C3+ hydrocarbons per 16 moles of C2 hydrocarbons. The composition of the first recycle stream may include from 1 to 20, preferably 2 to 10 moles of C3+ hydrocarbons per 100 moles of C1 and/or C2 hydrocarbons.

The withdrawn, first recycle stream is incorporated into the feed mixture that is provided in step 110. This helps to recover the C1, C2, and C3+ hydrocarbons in the first recycle stream for further processing in the separation steps 112 and 114. This recycle strategy is one aspect of the ability of the present invention to recover purified natural gas in step 102 and purified NGL in step 104 in high yield.

Also as a result of the gas-liquid separation of step 122, the tail remainder stream is withdrawn and fed to a further gas-liquid separation in step 124. As withdrawn from step 122, the tail remainder stream generally is in a liquid phase. At this stage of processing, the tail remainder stream may be more enriched in C3+ hydrocarbons, but more C1 and C2 material still may be present than is desired. Accordingly, a further gas-liquid separation is carried out in step 124 to remove more C1 and/or C2 content and thereby provide the purified NGL product 104. To accomplish this, step 124 comprises reducing the pressure of the tail remainder stream. This causes more of the tail remainder stream to vaporize. Generally, the resultant gas is enriched in C1 and C2 hydrocarbons relative to the tail remainder stream as supplied to step 124. Similarly, the liquid is enriched in C3+ hydrocarbons relative to the tail remainder stream as supplied to step 124.

Step 124 further comprises carrying out a gas-liquid separation in order to separate the gas and liquid materials. This involves withdrawing the gas as a second recycle stream in step 118, to separate the gas from the liquid, which provides depressurized tail remainder stream. The depressurized tail remainder stream is then collected as the second product 104 in the form of the purified NGL. This NGL product stream is enriched in at least one C3+ hydrocarbon relative to the tail remainder stream supplied to step 124. As described above, in some embodiments the purified NGL stream may include 80 to 95 moles of C3+ hydrocarbons per 5 to 20 moles of C1 and/or C2 hydrocarbons.

In the meantime, the separated gas material is withdrawn in step 118 as a second recycle stream that is enriched in at least one of the C1 and/or C2 hydrocarbons relative to tail remainder stream supplied to step 124. This second recycle stream is then incorporated into the first product stream downstream from the adsorbent separation carried out in step 112. This incorporation provides the purified NG product 102. In a typical mode of operation, this second recycle stream may still include 2 to 20, or even 5 to 15 moles of C3+ per 100 moles of C1 and/or C2 hydrocarbons. However, the relative flow rate of the second recycle stream relative to the first product stream is sufficiently low such that the purified NG product provided in step 102 remains highly pure, e.g, over 95 or even over 98, or even over 99 mole percent C1 and C2 hydrocarbons based on the total quantity of hydrocarbons in the purified NG product, even after this incorporation.

Figure 2:
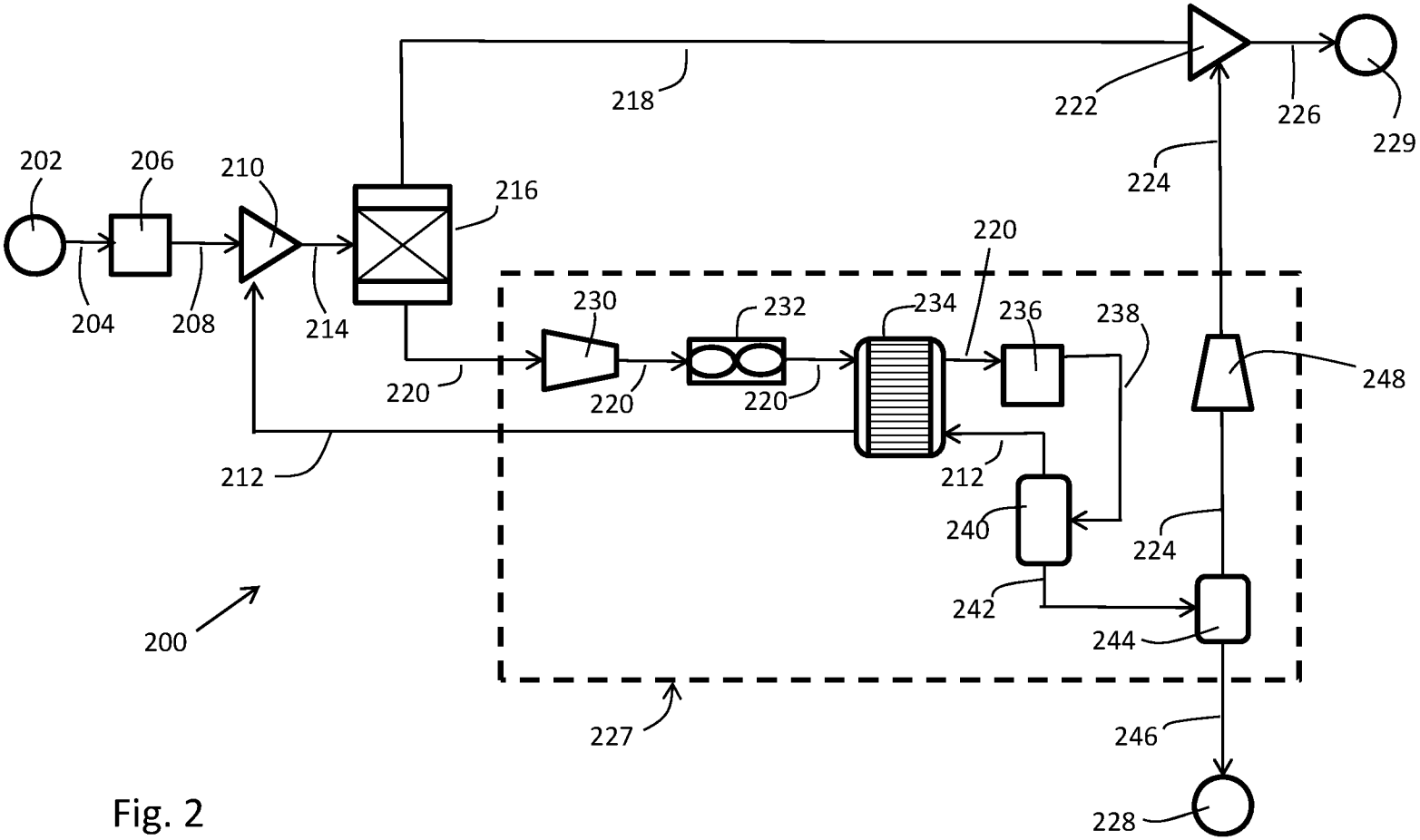
FIG. 2 schematically shows one illustrative embodiment of a system of the present invention useful to separate hydrocarbon feed mixtures into purified light and heavy components, respectively.

FIG. 2 shows an illustrative embodiment of a purification system 200 that can practice the method of FIG. 1 in order to separate C1 and C2 hydrocarbons from C3+ hydrocarbons. For purposes of illustration, system 200 will be described in the context of accomplishing this separation with respect to raw natural gas that comprises one or more of C1 and C2 hydrocarbons and one or more C3+ hydrocarbons. Accordingly, system 200 is fluidly coupled to one or more sources 202 of such raw natural gas. Line 204 fluidly couples the natural gas source(s) 202 to one or more optional pre-treatment systems 206. Pre-treatment systems 206 may be used to remove one or more contaminants from the raw natural gas. Examples of such contaminants may include one or more of carbon dioxide, water, nitrogen, hydrogen sulfide, mercaptans, mercury, chlorides, helium, or the like. The treated natural gas is then fed by line 208 to mixer 210. Mixer combines the natural gas fed by line 208 with a first recycle stream (described further below) fed to mixer 210 by recycle line 212. The mixer may be a simple juncture at which pipes join, where effective mixing tends to occur as the streams are joined.

The combination of mixed streams in mixer 210 provides a feed mixture that is supplied by a supply conduit pathway in the form of line 214 to a pressure swing adsorption (PSA) system 216. As described above with respect to FIG. 1, the pressurized feed mixture may be at a pressure in the range from 50 to 700 psig, preferably 150 to 250 psig and a temperature in the range from 0 C to 100 C, preferably 10 C to 60 C. In one mode of practice, a temperature of 21 C and a pressure of about 230 psig would be suitable. As an option, the feed mixture may be pressurized before being introduced into the PSA system 216. A suitable feed pressure for the PSA system 216 is in the range from 50 to 700 psig, preferably 150 to 250 psig and a temperature in the range from 0 C to 100 C, preferably 10 C to 60 C. Pressurizing the feed mixture might involve additional cost to install and run a pressurizing unit (not shown), but in many instances this cost can be offset by the ability to use a significantly smaller PSA system.

PSA system 216 provides an adsorbent bed system comprising one or more adsorbent beds, wherein each adsorbent bed comprises one or more adsorbents (described above) that selectively adsorb C3+ hydrocarbons relative to C1 and/or C2 hydrocarbons from the feed mixture. Consequently, adsorption separation techniques may be used by system 216 to help separate the C1 and C2 hydrocarbon content of the feed mixture from the C3+ hydrocarbon content of the feed mixture.

To accomplish the separation, PSA system 216 comprises a first configuration in which the feed mixture is separated into at least one C1 and/or C2 enriched first product stream that is discharged from system 216 via at least one outlet conduit illustrated as line 218. The first product stream is enriched in C1 and/or C2 hydrocarbons relative to the C1 and/or C2 content of the feed mixture supplied to system 216 via line 214. The first product stream generally is a gas. The first product stream withdrawn from PSA system 216 via line 218 is combined in a mixer 222 with a second recycle stream 224 in order to supply purified natural gas product 229 via line 226. The second recycle stream also is generally a gas. In illustrative modes of practice, the first product stream is at a pressure in the range from 100 to 300 psig, preferably 150 to 250 psig and a temperature in the range from 25 C to 100 C, preferably 40 C to 90 C. In one mode of practice, a temperature of 65 C and a pressure of about 220 psig would be suitable.

A typical PSA system may be used to prepare first product streams, sometimes also referred to in the industry as treated gas streams, that are highly pure in C1 and C2 hydrocarbon content while including very little if any C3+ hydrocarbon content. For example, the first product stream may include 80 mole percent to about 100 percent, more preferably about 90 mole percent to about 99.9 mole percent, even more preferably about 95 mole percent to about 99.9 mole percent of C1 and C2 hydrocarbons based on the total quantity of hydrocarbons in the first product stream. In one embodiment, a dual stage PSA system is used to treat a natural gas stream containing 10 mole percent to 20 mole percent of C3+ hydrocarbons based on the total quantity of the hydrocarbons in the natural gas stream. This would provide a first product stream containing less than 1 mole percent of C3+ hydrocarbons based on the total weigh of the hydrocarbons in the natural gas stream.

While system 216 is in the first configuration, portions of the feed mixture are selectively adsorbed onto at least one adsorbent bed. Due to the selective adsorption properties of the adsorbent material, the adsorbed material is enriched in one or more C3+ hydrocarbons relative to the C1 and/or C2 hydrocarbons in the feed mixture.

PSA system 216 also comprises a second configuration in which the one or more adsorbed portions of the feed mixture are released from at least one of the one or more adsorbent beds to provide at least one C3+ enriched, first tail stream that is discharged from PSA system 216 via an outlet conduit in the form of line 220. In many modes of practice, the tail stream is discharged via line 220 as a gas stream. The gas stream may be at any suitable temperature and pressure. In a typical mode of practice, the discharged gas stream is at 1 atm and 10° C. In some modes of practice, PSA system 216 is in the form of a dual stage PSA system. While at least one vessel adsorbs, at least one other vessel desorbs to regenerate the adsorbent media and release adsorbed material. After a time, the roles are switched so that adsorption and regeneration can occur continuously.

In a typical mode of operation, a feed mixture containing 10 mole percent to 20 mole percent of C3+ hydrocarbons based on the total quantity of the hydrocarbons in the natural gas stream may provide a first tail stream containing 20 to 60 mole percent of C3+ hydrocarbons based on the total weigh of the hydrocarbons in the tail stream. At this level of enrichment, however, the C3+ hydrocarbon content of the tail stream may still be too dilute to be suitable for use as an NGL product 228 according to some NGL product specifications. Accordingly, the first tail stream is further processed in liquefaction system 227 in order to provide a more purified NGL product 228 that is more enriched in one or more C3+ hydrocarbons relative to the feed mixture supplied to the PSA system 216. Additionally, liquefaction system 226 is used to produce the first recycle stream that is fed to mixer 210 by line 212. Liquefaction system 226 also produces the second recycle stream that is fed to mixer 222 by line 224.

Pressurizing and cooling the tail stream provides a pressurized and cooled, partially liquefied tail stream that is discharged from chiller 236 via line 238. A partially liquefied tail stream desirably is pressurized and cooled under conditions effective to partition the contents of the partially liquefied tail stream into a gas containing 1 to 20, preferably 2 to 10 moles of C3+ hydrocarbons per 100 moles of C1 and/or C2 hydrocarbons; and a liquid containing 50 to 80 moles of C3+ hydrocarbons per 20 to 50 moles of C1 and/or C2 hydrocarbons, more preferably 60 to 75 moles of C3+ hydrocarbons per 20 to 50 moles of C1 and/or C2 hydrocarbons. Illustrative temperature and pressure ranges are discussed above with respect to FIG. 1. In one mode of operation, a pressure of 230 psig and a temperature of −25° C. would be suitable. As a result of pressurization and cooling, the liquid phase is enriched with respect to one or more C3+ hydrocarbons relative to the first tail stream supplied to the liquefaction system 227, while the gas phase is enriched in C1 and/or C2 hydrocarbons relative to the first tail stream supplied to the liquefaction system 227. The creation of the two phases allows easy separation so that the resultant separated liquid stream is further purified in one or more C3+ hydrocarbons, while the separated gas stream can be recycled back to the adsorbent system 216 via line 212.

Liquefaction system 227 includes a pressurizing system and a cooling system that in the illustrated embodiment contains at least two cooling stages. Compressor 230 is used to pressurize the tail stream. In some embodiments, compressor 230 compresses the tail stream to a pressure that is less than 100 psia, more preferably less than 50 psia, or even less than 20 psia greater than the pressure of the feed mixture supplied to PSA system 216. This pressure difference helps to ensure, as one illustrative benefit, that the pressure of the gas in the first recycle stream after pressure losses occurring in liquefaction system 227 is comparable to that of the feed mixture to avoid needing more compressor functionality downstream from compressor 230.

Compression causes the pressurized material to get hot. Accordingly, the pressurized material is then cooled in two more stages to achieve the desired degree of partial liquefaction of the tail stream. The two or more cooling stages may or may not include a chiller with an external refrigerant. For purposes of illustration, liquefaction system 227 is shown as including three cooling stages including air cooler 232, heat exchanger 234, and chiller 236 incorporated into line 220 that cool the pressurized tail stream to provide a pressurized and cooled tail stream that is partially liquefied. Cooling in multiple steps this way is more economical overall than trying to refrigerate the pressurized material in a single stage.

As the separated, cooled gas is conveyed back to the adsorbent system 216 along line 212, its passage through the heat exchanger 234 helps to cool the tail material flowing through the heat exchanger 234 along line 220. This second stage of cooling in combination with the cooling provided by air cooler 230 helps to reduce the refrigeration demand upon chiller 236, making the cooling process more efficient and economical. Desirably, chiller 236 comprises a mechanical refrigeration unit and avoids cryogenic or other technologies that require a reboiler to accomplish a cooling cycle.

The pressurized and cooled tail stream is directed from chiller 236 to a gas-liquid separator tank 240 along line 238. In many embodiments, this is a simple tank in which liquid under the influence of gravity is withdrawn from a bottom region of tank 240 through line 242 while the gas is withdrawn from a top region of the tank 240 by line 212. The withdrawn liquid provides a tail remainder stream that is enriched in at least one C3+ hydrocarbon relative to the pressurized and cooled, partially liquefied tail stream fed to tank 240. The withdrawn gas constitutes the first recycle stream that is enriched in C1 and/or C2 hydrocarbons relative to the pressurized and cooled, partially liquefied tail stream fed to tank 240.

The tail remainder stream withdrawn from tank 240 through line 242 tends to be predominantly a liquid and still may include more C1 and/or C2 content than might be desired to provide a purified NGL product with one or more C3+ hydrocarbons of sufficient purity relative to remaining C1 and/or C2 content. In order to further purify this liquid stream, the stream is subjected to at least one additional gas-liquid separation. However, in order to do this, more of the stream needs to be partitioned into a gas phase. This is accomplished by transferring the tail remainder stream to flash tank 244 via line 242. In the flash tank, the pressure is reduced to cause more of the material to vaporize into the gas phase. As was the case with the tank 240, the gas phase tends to be enriched with respect to C1 and/or C2 hydrocarbons relative to the tail remainder stream supplied to tank 244, while the liquid phase tends to be enriched in one or more C3+ hydrocarbons relative to the tail remainder stream supplied to tank 244.

The resultant gas and liquids are easily separated. Under the force of gravity, the liquid stream, now in the form of purified NGL product 228 is withdrawn from a lower portion of tank 244 via line 246. The gas is withdrawn from an upper portion of tank 244 via line 224 as a second recycle stream. The second recycle stream is then combined with the first product stream from line 218 in mixer 222 downstream from the adsorbent system 216 to provide the purified natural gas product 229. Optionally, a compressor 248 may be used on the line 224 in order to pressurize the second recycle stream to better match the pressure of the first product stream.

The natural gas product 229 may be flared for disposal but it has many uses such as fuel or the like. Desirably, therefore, less than 10 mole percent, more preferably less than 5 mole percent, or even less than 1 mole percent based on the total quantity of the natural gas product 229 is flared or otherwise disposed of without further use, handling, or storage. The natural gas product 229 desirably has a pressure below about 700 psig, preferably below about 500 psig, more preferably below about 300 psig. The natural gas product 229 desirably has a BTU content below about 1150 BTU/scf (Standard Cubic Foot), preferably below about 1050 BTU/scf, more preferably below about 1000 BTU/scf.

Advantageously, most of the C2 content of the feed mixture, eg., at least 80 mole percent of the C2 content based on the total quantity of the C2 content of the feed mixture is recovered in the first product stream so that 20 mole percent of less of the C2 content of the feed mixture is recovered in the NGL product 228. By limiting the C1 and C2 content of the purified NGL product 228, the NGL product 228 desirably has a vapor pressure at 100° F. below about 400 psig, preferably below about 300 psig, even more preferably below about 200 psig. Often, the NGL product 228 is at a sufficiently high pressure to exist in predominantly liquid form. The pressure desirable is sufficiently high so that even C2 content in the NGL product 228 is substantially entirely in the liquid phase. To the extent that methane is present in the NGL product 228, it may exist in a gas phase that is dissolved in the liquid.

Practicing the method 100 of FIG. 1 in system 200 of FIG. 2 provides many advantages. The resulting natural gas product 229 is lean in C3+ hydrocarbons and is suitable for power generation and chemicals production rather than being flared for disposal. This ability to eliminate flaring is particularly useful in those many countries that follow the "Zero Routine Flaring by 2030" initiative. The product gas 229 can efficiently be used for power generation due to the low energy content of the gas. Flare elimination can be important as government flaring penalties can be structured in ways that reward flare elimination much more than flare reduction. In addition to eliminating flare equipment, a flare elimination design can reduce the need for additional monitoring, reporting, permitting, and other compliance issues. In parallel, system 200 produces the purified NGL product 228 that is lean in C1 and C2 content. The NGL product 228 can be collected and sold to meet market demand.

The principles of the present invention also use light hydrocarbon production to help improve NGL purification. Further, once an initial separation between light and heavy components is achieved, the heavy components use liquefaction principles to further purify the heavy component in multiple separation stages. As the heavy component is further purified in each stage, withdrawn material is recycled or incorporated into product streams. The liquefaction system uses both a high pressure separator as well as a flash tank as separate stages of NGL purification. An initial high pressure liquid-gas separation allows for substantial methane elimination and some C2 elimination from the heavy stream at high pressure while also carrying some C3+ material back to the PSA unit for reprocessing. Additional C2 material and some more C1 material can be further rejected from the NGL stream by utilizing the flash vessel to meet Reid vapor pressure requirements.

Figure 3:
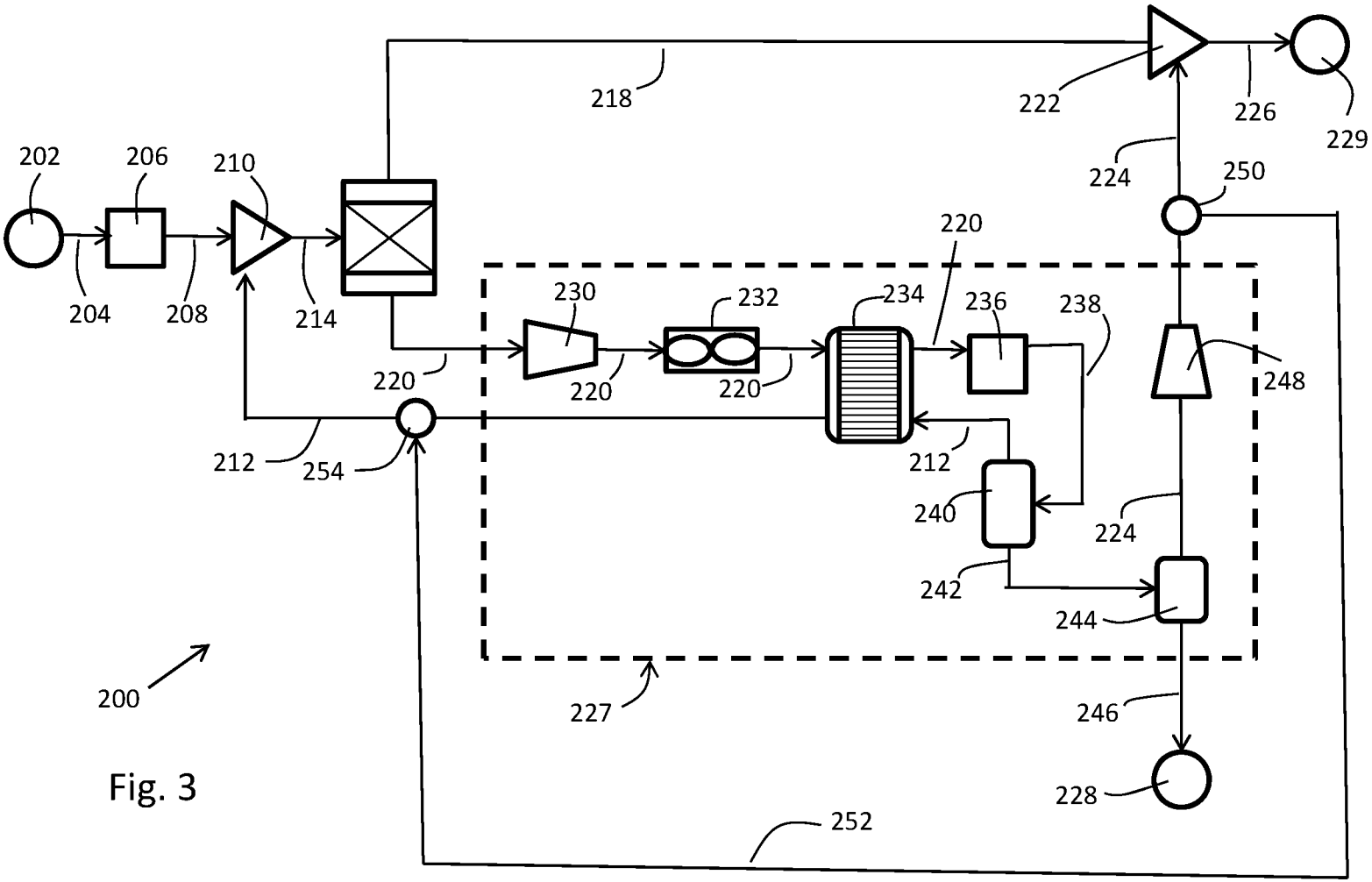
FIG. 3 schematically shows an alternative embodiment of the system of FIG. 2 further including an additional recycle pathway to combine first and second recycle streams prior to incorporating the combined recycle streams into a feed mixture.

FIG. 3 shows additional features that may be included in system 200. Line 224 is fitted with a valve 250 to allow some or all of the second recycle stream to be diverted from line 224 into line 252. From line 252, the withdrawn second recycle stream can be combined with the first recycle stream via the juncture at valve 254. The combined recycle streams can then be incorporated into the feed mixture at mixer 210.

Figure 4:
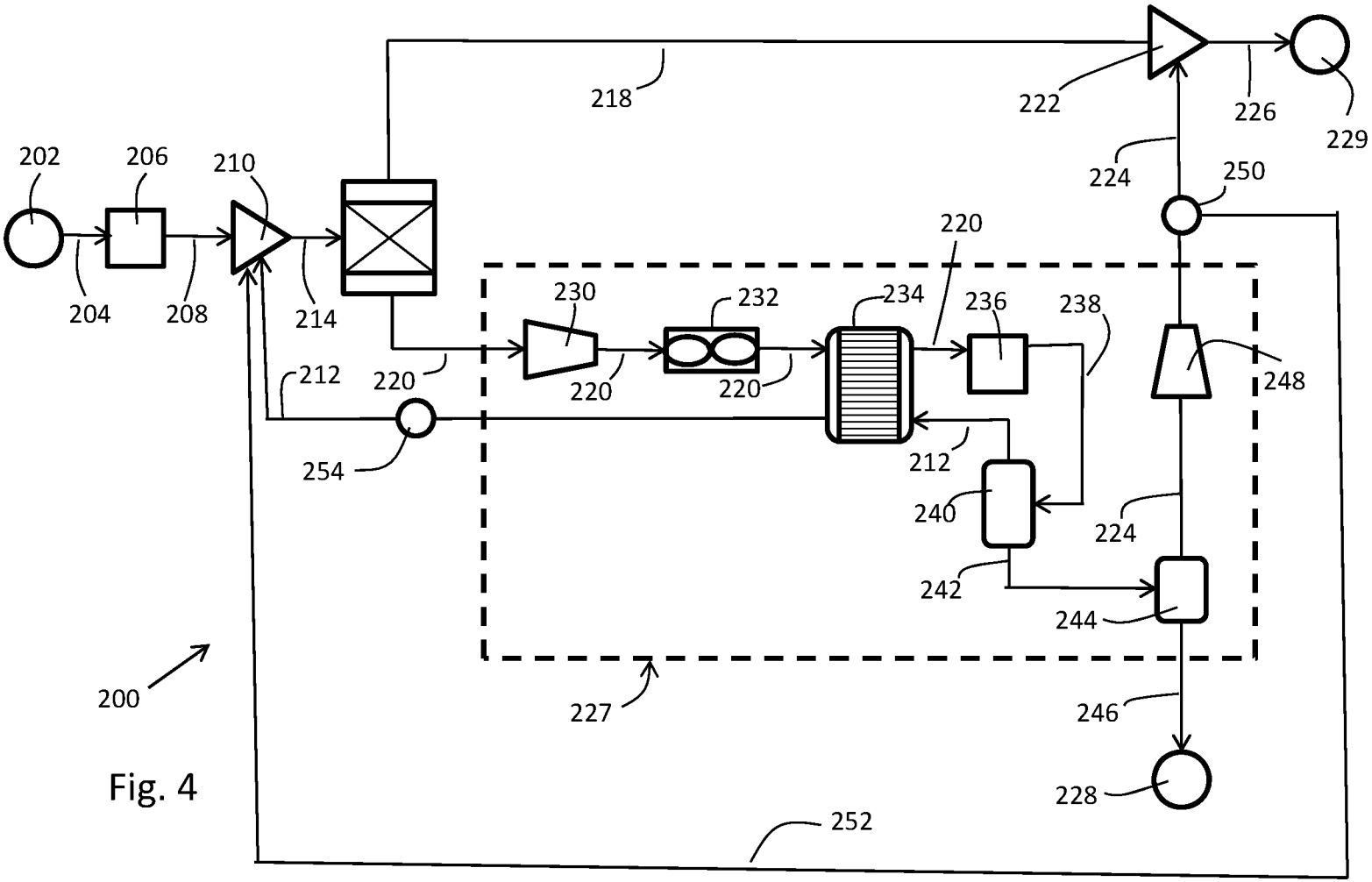
FIG. 4 schematically shows an alternative embodiment of the system of FIG. 2 further including an additional recycle pathway to independently mix first and/or second recycle streams into a feed mixture.

FIG. 4 shows an alternative embodiment for how line 252 of FIG. 3 can be configured. In FIG. 4, line 252 is led to mixer 210 so that the first and second recycle streams can be independently controlled and introduced into the feed mixture.

The present invention will now be further described with reference to the following illustrative example.

EXAMPLE

This example provides a material balance to illustrate the performance of using the method 100 of FIG. 1 in the system 200 of FIG. 2. The material balance is shown in Table 2 of FIG. 5, wherein the amounts of materials are expressed on a mole percent basis, the mole flow in LBMOL/HR is an abbreviation for pound-mol per hour, the mass flow is in kg/hr, pressure is in PSIG, and temperature is in degrees Fahrenheit. In Table 1, the streams referred to in Table 2 are defined as follows:

TABLE 1

| Stream in Table 2 | Corresponding stream in FIG. 2 |
|---|---|
| Feed | Natural gas fed to mixer 210 via line 208 |
| PSA Feed | Feed mixture fed to unit 216 via line 214 |
| Treated | First product stream fed to mixer 222 via line 218 |
| Tail | First tail stream fed to compressor 203 via line 220 |
| 1 | Tail stream after emerging from compressor 230 on line 220 |
| 2 | Tail stream after emerging from air cooler 232 on line 220 |
| 3 | Tail stream after emerging from heat exchanger 234 on line 220 |
| 4 | Pressurized and cooled tail remainder stream after emerging from chiller 236 on line 238 |
| 5 | First recycle stream withdrawn from tank 240 via line 212 upstream from heat exchanger 234 |
| Recyc | First recycle stream after emerging from heat exchanger 234 on line 212 |
| 6 | Tail remainder stream withdrawn from tank 240 on line 242 |
| 7 | Second recycle stream withdrawn from tank 244 on line 224 |
| Offgas | Second recycle stream after pressurization by compressor 248 |
| Product | Product 229 |
| NGL | Product 228 |

The material balance of Table 2 (FIG. 5) shows that the present invention may have a dramatic impact upon parallel recovery of NG and NGL product streams. In addition to the efficient two stage separation to purify the tail stream using liquefaction techniques, the present invention also addresses the challenge of incorporating recycle without returning undue amounts of ethane to the PSA. The high pressure separator can focus on primarily methane rejection from the heavy stream while the flash can focus primarily on ethane rejection from the heavy stream. The rejected ethane from the flash can be combined with the feed mixture or the product mixture. FIG. 2 shows the rejected ethane of the second recycle stream being combined with the NG product. FIG. 4 shows an alternative embodiment in which the second recycle stream can be incorporated into the feed mixture. Withdrawing the second recycle stream may increase the C3+ concentration of the product 229, but the effect upon C3+ content of the product 229 is small since the second recycle stream is much smaller than the first product stream. One result is a much leaner NG product 229 containing only 0.7% C3+, which results in higher C3+ recovery as product 228. The design in this material balance was able to recover about 93% of C3+ hydrocarbons into the NGLs product 228.

All patents, patent applications, and publications cited herein are incorporated herein by reference in their respective entities for all purposes. The foregoing detailed description has been given for clarity of understanding only. No unnecessary limitations are to be understood therefrom. The invention is not limited to the exact details shown and described, for variations obvious to one skilled in the art will be included within the invention defined by the claims.

What is claimed is:

1. A method of separating C1 and C2 hydrocarbons from C3+ hydrocarbons, comprising the steps of:

a. providing a feed mixture comprising (i) at least one of C1 and/or C2 hydrocarbons, and (ii) one or more C3+ hydrocarbons;

b. using at least one adsorbent to separate the feed mixture into a light component that is enriched in C1 and/or C2 hydrocarbons relative to the feed mixture and a heavy component that is enriched in C3+ content relative to the feed mixture;

c. using pressure and temperature to cause the heavy component to be partially liquefied to include a first liquid portion and a first gas portion;

d. separating the, first liquid portion and the first gas portion, wherein the separated first liquid portion is enriched in at least one C3+ hydrocarbon relative to the heavy component, and wherein the separated first gas portion is enriched in methane relative to the heavy component;

e. reducing the pressure of the separated first liquid portion to separate the first liquid portion into a separated, second liquid portion and a separated, second gas portion, wherein the separated second liquid portion is enriched in at least one C3+ hydrocarbon relative to the separated first liquid portion, and wherein the separated second gas portion is enriched in ethane relative to the separated first liquid portion; and f. incorporating at least one of the separated, first and second gas portions into the feed mixture.

2. The method of claim 1, wherein the feed mixture comprises 5 to 30 moles of C3+ hydrocarbons per 80 to 100 moles of C1 and/or C2 hydrocarbons.

3. The method of claim 1, wherein the feed mixture supplied to the at least one adsorbent is at a pressure in the range from 50 psig to 700 psig and at a temperature in the range from 0 C to 100 C.

4. The method of claim 1, wherein the separated first gas portion is recycled into the feed mixture and wherein the separated second gas portion is incorporated into a product comprising the light component and the separated second gas portion.

5. The method of claim 1, wherein the separated first and second gas portions are incorporated into the feed mixture.

6. The method of claim 1, wherein step (b) comprises contacting the feed mixture with the at least one adsorbent at an adsorbent bed pressure effective to selectively adsorb C3+ hydrocarbons onto the at least one adsorbent relative to the C1 and/or C2 hydrocarbons.

7. The method of claim 6, wherein step (b) further comprises reducing the adsorbent bed pressure to release the adsorbed C3+ hydrocarbons from the adsorbent in a manner effective to provide the separated heavy component.

8. The method of claim 1, wherein the feed mixture contacts the at least one adsorbent bed at a pressure in the range from 50 psig to 700 psig and a temperature in the range from 0 C to 100 C.

9. The method of claim 1, wherein step (c) comprises causing the heavy component to be partially liquefied at a temperature in the range from −40 C to 15 C and a pressure in the range from 50 psig to 300 psig.

10. The method of claim 9, wherein step (c) comprises cooling the heavy component using at least two cooling stages.

11. The method of claim 10, wherein the cooling stages comprises air cooling the heavy component, using heat exchange to cool the heavy component, and using a chiller to cool the heavy component.

12. The method of claim 10, wherein cooling the heavy component comprises using heat exchange between the heavy component and the separated first gas portion.

13. The method of claim 9, wherein the partially liquefied pressure of the heavy component is higher than the feed mixture pressure and wherein the partially liquefied pressure of the heavy component is less than 20 psig greater than the pressure of the feed mixture.

14. The method of claim 9, further comprising using the separated first gas portion to cool the heavy component after the first gas portion is separated from the first liquid portion.

15. The method of claim 1, wherein the separated second liquid portion includes 80 to 95 moles of C3+ hydrocarbons per 5 to 20 moles of C1 and/or C2 hydrocarbons.

16. The method of claim 1, wherein the separated, second gas portion comprises 5 to 15 moles of C3+ hydrocarbons per 100 moles of C1 and/or C2 hydrocarbons.

17. A method of separating C1 and C2 hydrocarbons from C3+ hydrocarbons, comprising the steps of:

a. providing a feed mixture comprising (i) at least one of C1 and/or C2 hydrocarbons, and (ii) one or more C3+ hydrocarbons;

b. separating the feed mixture into a first product stream and a first tail stream, wherein the first product stream is enriched in at least one of the C1 and/or C2 hydrocarbons relative to the feed mixture, and wherein the first tail stream comprises at least one of the C1 and/or C2 hydrocarbons and is enriched in at least one C3+ hydrocarbon relative to the feed mixture;

c. partially liquefying the first tail stream under conditions such that the partially liquefied first tail stream comprises at least one tail stream gas and at least one tail stream liquid;

d. withdrawing a first recycle stream from the partially liquefied tail stream to provide a tail remainder stream that is enriched in at least one C3+ hydrocarbon relative to the partially liquefied tail stream, wherein the first recycle stream comprises at least a portion of the tail stream gas and is enriched in at least one of the C1 and/or C2 hydrocarbons relative to the tail stream;

e. incorporating the withdrawn, first recycle stream into the feed mixture;

f. reducing the pressure of the tail remainder stream under conditions effective to provide a depressurized tail remainder stream comprising at least one tail remainder gas and at least one tail remainder liquid;

g. separating the depressurized tail remainder stream into a second recycle stream and a second product stream, wherein the second product stream is enriched in at least one C3+ hydrocarbon relative to the depressurized tail remainder stream, and wherein the second recycle stream is enriched in at least one of the C1 and/or C2 hydrocarbons relative to the feed mixture; and h. incorporating at least one of the first recycle stream and the second recycle stream into the feed mixture.

18. The method of claim 17, wherein step (b) comprises using at least one adsorbent under conditions effective to separate the feed mixture into the first product stream and the first tail stream.

19. The method of claim 18, further comprising the steps of incorporating the first recycle stream into the feed mixture and incorporating the second recycle stream into the first product stream.

20. A system for separating C1 and C2 hydrocarbons from C3+ hydrocarbons, comprising:

a) an adsorbent bed system comprising one or more adsorbent beds, each adsorbent bed comprising one or more adsorbents that selectively adsorb C3+ hydrocarbons relative to C1 and/or C2 hydrocarbons from a feed mixture comprising (i) at least one of C1 and/or C2 hydrocarbons; and (ii) one or more C3+ hydrocarbons, wherein the adsorbent bed system comprises:

i. a first configuration in which the feed mixture is separated into at least one C1 and/or C2 enriched output stream while one or more C3+ enriched portions of the feed mixture are selectively adsorbed onto at least one adsorbent bed;

ii. a second configuration in which the one or more C3+ portions of the feed mixture are released from at least one of the one or more adsorbent beds to provide at least one C3+ enriched, first tail stream;

iii. at least one supply conduit pathway through which the feed mixture is supplied to the adsorbent bed system;

iv. at least one outlet conduit through which at least one C1 and/or C2 enriched output stream is discharged from the adsorbent bed system while one or more C3+ hydrocarbons of the feed mixture are selectively adsorbed onto the one or more adsorbent beds relative to the C1 and/or C2 hydrocarbons in the feed mixture; and v. at least one outlet conduit through which the at least one C3+ enriched, first tail stream is discharged from the adsorbent bed system;

b) a liquefaction system, comprising:

i. a first separation portion that separates the C3+ enriched, first tail stream into a first recycle stream and a tail remainder stream, wherein the first recycle stream is enriched in C1 and/or C2 hydrocarbons relative to the C3+ enriched, first tail stream, and wherein the tail remainder stream is enriched in at least one C3+ hydrocarbon relative to the C3+ enriched, first tail stream; and ii. a second separation portion that separates the tail remainder stream into a second recycle stream and a further C3+ enriched tail stream, wherein the second recycle stream is enriched in C1 and/or C2 hydrocarbons relative to the tail remainder stream, and wherein the further C3+ enriched tail stream is enriched in at least one C3+ hydrocarbon relative to the tail remainder stream;

c) a first recycle pathway that couples the liquefaction system to the adsorbent bed system in a manner effective to cause the first recycle stream to be incorporated into the feed mixture upstream from at least one adsorbent bed of the pressure swing adsorption system; and d) a second recycle pathway that causes the 2nd recycle stream to be incorporated into the first product stream downstream from the adsorbent bed system.

* * * * *